United States Patent [19]

Gillam et al.

[11] Patent Number: 4,481,388

[45] Date of Patent: Nov. 6, 1984

[54] ELECTRICAL PLUG WITH AUTOMATIC SHUT-OFF FEATURE

[75] Inventors: David R. Gillam, Bisley; John A. Rolfe, Tring, both of England

[73] Assignee: Electrak International, Inc., London, England

[21] Appl. No.: 469,192

[22] Filed: Feb. 24, 1983

[30] Foreign Application Priority Data

Feb. 26, 1982 [GB] United Kingdom ..... 8205735

[51] Int. Cl.[3] ..... H01R 13/70

[52] U.S. Cl. ..... 200/51 R; 200/51.09; 200/51.05; 361/361

[58] Field of Search ..... 200/50 R, 50 B, 51 R, 200/51.02, 51.03, 51.05, 51.07, 51.08, 51.09, 51.1, 51.11, 51.12, 676, 334; 339/88 R, 22 B, 21 R; 361/355, 361, 400, 405

[56] References Cited

U.S. PATENT DOCUMENTS

| | | | |
|---|---|---|---|
| 1,901,040 | 3/1933 | Peroni et al. | 200/51.09 |
| 2,076,136 | 4/1937 | Weed | 200/51 R |
| 2,179,797 | 11/1939 | Nemet | 200/51.09 |
| 2,610,266 | 9/1952 | Greeson | 200/51.09 |
| 2,636,950 | 4/1953 | Broodway | 200/51.07 |
| 2,942,224 | 6/1960 | Messing | 339/21 |
| 2,986,613 | 5/1961 | Figueira | 200/51.09 |
| 3,188,416 | 6/1965 | Schultz | 200/51.09 |
| 3,539,736 | 11/1970 | Naimer | 200/153 LA |
| 3,588,402 | 6/1971 | Heath | 200/67 G |
| 3,611,252 | 10/1971 | Fremont | 339/21 R |
| 4,032,208 | 6/1977 | Berkenhoff | 200/51.08 X |
| 4,163,595 | 8/1979 | Vasseur | 339/88 R |

FOREIGN PATENT DOCUMENTS

| | | |
|---|---|---|
| 143599 | 5/1920 | United Kingdom . |
| 419321 | 11/1934 | United Kingdom . |
| 1520151 | 8/1978 | United Kingdom . |

*Primary Examiner*—Charles E. Phillips
*Assistant Examiner*—Ernest G. Cusick
*Attorney, Agent, or Firm*—Krass & Young

[57] ABSTRACT

An electrical plug comprises a plug body which houses two or more electrical terminals for connection to electrical cables, at least one of the terminals being conductively connectable and disconnectable from its respective contact pin. To achieve this, the plug body is provided with a tumbler switch, operable to effect electrical contact between a spring contact permanently conductively connected to the contact pins and the terminal by means of a pivoted lever normally biassed out of contact with the terminal by means of the spring contact. The rocker of the switch may be operated manually, but manual operation will be over-ridden on insertion and withdrawal of the plug from its complementary socket. The automatic switch control means comprises an axially slidable pin projecting from the plug body in the "switch on" position and retractable into the plug body on engagement of the axially slidable pin with the front face of the complementary socket, to urge the switch into the "off" position. The free end of the pin may be provided with a cam surface for cooperation with the socket on rotational withdrawal of the plug from the socket, to switch the plug off on withdrawal as well.

7 Claims, 5 Drawing Figures

ELECTRICAL PLUG WITH AUTOMATIC SHUT-OFF FEATURE

BACKGROUND OF THE INVENTION

The present invention relates to electrial plugs and more particularly to switched electrical plugs.

These are plugs which incorporate a switch in the body of the plug itself, so that an appliance which is attached to the plug may be switched on at the plug, without needing to switch on at the appliance, or without having to switch at the socket. Such a plug is clearly useful with a socket having no switch or for use with an adapter when it is not always wanted to switch all the appliances which are connected to the socket by the adapter, which would occur when switching at the socket.

The invention concerns any type of electrical plug. Thus, conventional two- or three-pin plugs, insertable into a scoket by sliding the plug axially with respect to the contact pins of the plug, are contemplated by the invention, as is the type of plug which is pushed into an aperture of a complementary socket, the plug then being rotated to bring its pins into contact with the conductors of the socket.

One problem which is associated with plugs is that arcing tends to occur between the plug contact pins and the socket if the circuit is not broken first by switching off the appliance, socket or plug before inserting or removing the plug from the socket. Arcing causes damage to the plug and socket and is a potential fire hazard.

It is an object of the present invention to provide a switched electrical plug which incorporates safety features, whereby the plug is automatically switched off when the plug is being inserted into, or removed from, a complementary socket.

SUMMARY OF THE INVENTION

According to a first aspect of the invention, there is provided an electrical plug for insertion into a complementary socket, which plug comprises a plug body housing at least two terminals to which cable leads may be connected, and at least two corresponding contact pins projecting from the body, characterised in that at least one of said terminals is conductively connectable to a respective contact pin, the plug further comprising a switch disposed between the at least one of said terminals and its respective contact pin, the switch being movable between an on position, in which the terminal and respective contact pin are conductively connected, and an off position in which the terminal and respective contact pin are isolated from one another, and switch control means adapted to be co-operable with a surface on said socket for automatically moving the switch into the off position when the plug is being inserted in and/or removed from the socket.

Suitably, the switch control means comprises an element movably mounted on the plug body, one portion of the element being operatively connected to the switch, a further portion of the movable element projecting out of the plug body when the switch is in the on position, said further portion of the element being retractable into the plug body when it engages said surface on the socket, the element thereby urging the switch into the off position when the plug is inserted into and/or removed from the socket.

Advantageously, the movable element comprises an axially slidable pin, one end of which is pivotally connected to the switch, the other, free end of the pin projecting out of the plug body when the switch is in the on position.

In one embodiment, in which the plug is of the kind adapted to be engaged with its complementary socket by axially pushing the plug into the socket followed by rotation of the plug through substantially 90°, the free end of the axially slidable pin is formed with a cam surface for engagement with said surface on the socket to cause retraction of the pin on removal of the plug from the socket.

The axially slidable pin is mounted on a guide surface on the plug body and in this embodiment of rotatable plug, it is advantageous if the axially slidable pin is of non-circular cross-section and the guiding surface on the plug body is of complementary cross-section to that of the pin. With such an arrangement, as the plug is rotated to remove it from the socket, the pin is restrained from rotating about its longitudinal axis, and is instead moved only axially by the surface on the socket.

The switch suitably comprises a tumbler switch.

According to a further aspect of the invention, there is provided an electrical plug of the type hereinbefore described, in combination with a complementary socket which houses electrical conductors, wherein the switch control means is adapted to move the switch automatically into the off position before contact is made between the contact pins of the plug and the conductors on insertion of the plug into the socket and/or before contact is broken between the plug contact pins and socket conductors before the plug is removed from the socket.

DESCRIPTION OF THE PREFERRED EMBODIMENT

Figure 1:
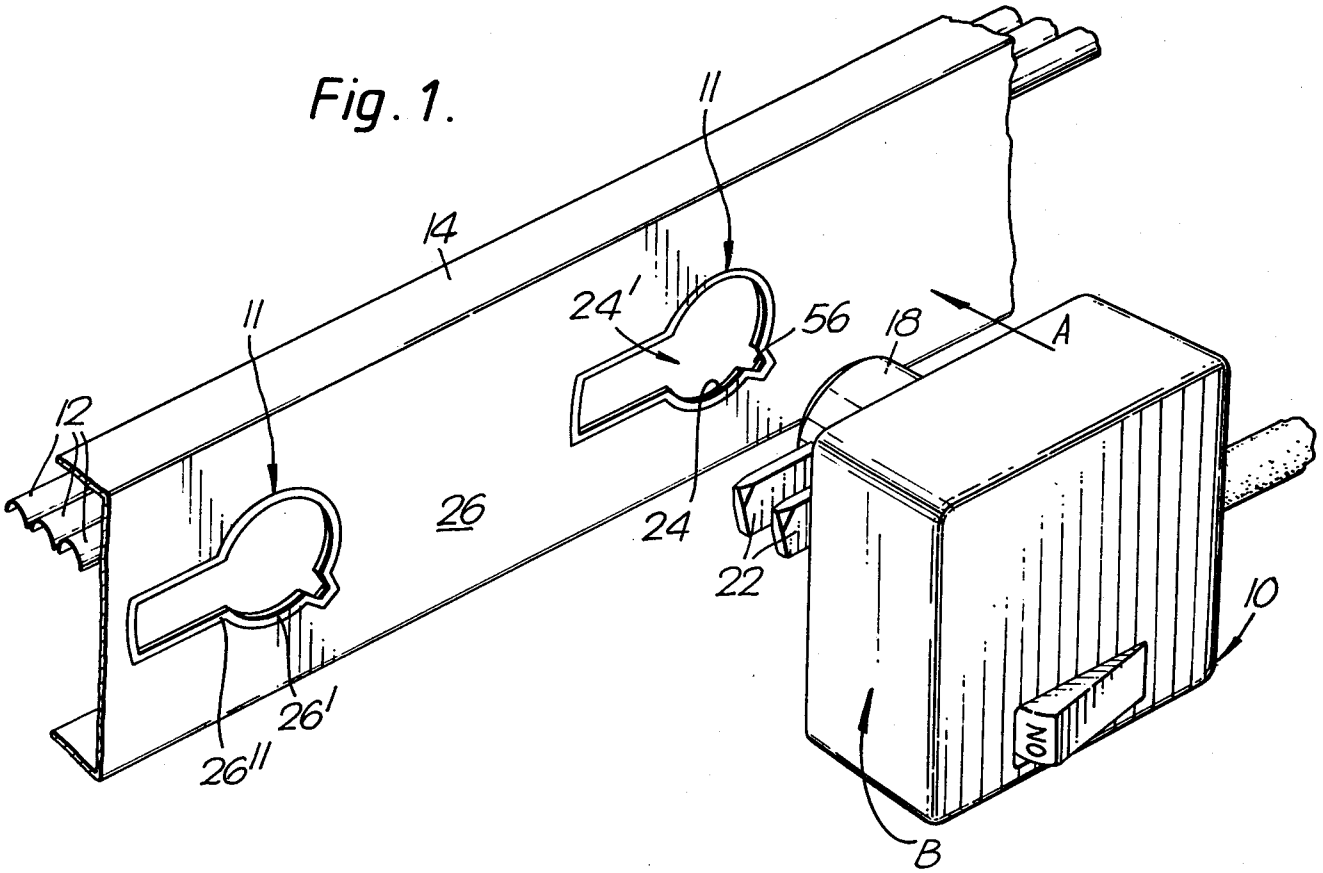
FIG. 1 shows a perspective view of a switched plug according to the invention, before the plug is inserted into one of two complementary sockets in an electrical track shown partially broken away.

Referring to the drawings, there is shown a plug 10 and a row of complementary sockets 11, all served by common conductors 12 housed in a conduit 14. The plug may be inserted into any one of the sockets 11.

The plug 10 generally comprises a body 16 having a portion 18 projecting from the front face 20 of the plug body 16. Extending from the projecting portion 18 of the plug body 16 are three contact pins 22.

The plug 10 is engaged in one of the sockets 11 by pushing the plug in the direction of arrow A (FIG. 1) to insert the projecting portion 18 of the plug body into the aperture 24 of the socket 11, until the front face 20 of the plug abuts the front wall 26 of the conduit 14. The apertures 24 are normally closed by outwardly sprung safety gates. The plug is then turned through substantially 90° in the direction of arrow B (FIG. 1). In this final engagement position of the plug, the pins 22 of the plug contact the respective conductors 12 in the conduit 14.

Figure 3:
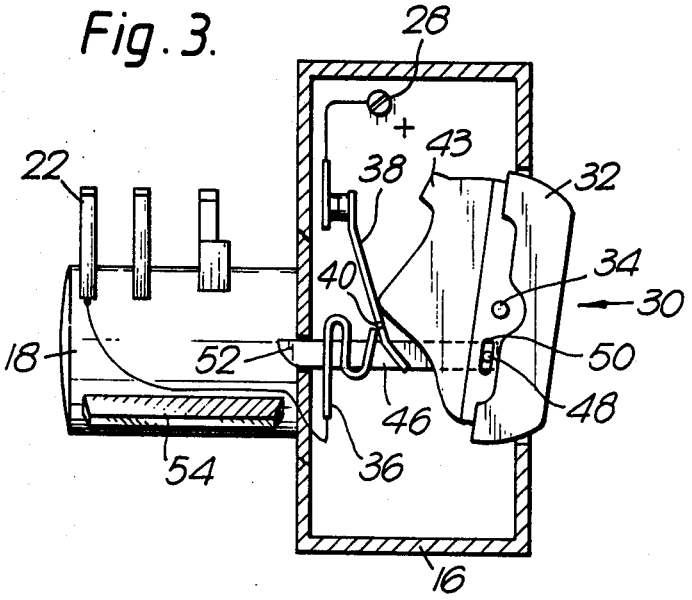
FIG. 3 shows a side view, partially in cross-section in two different cross-sectional planes, of the plug of FIGS. 1 and 2, the switch being in the on position.

The plug 10 incorporates a switch 30, whereby conductive connection can be made or broken between the positive terminal 28 in the plug body and the live pin 22 (FIG. 3). The switch 30, in the illustrated embodiment, is of the tumbler type, also known in the art as an over-center snap switch, and comprises a rocker 32 pivotally mounted at 34 on the plug body 16, a spring contact 36 permanently conductively connected to the pin 22 which is intended to contact the life conductor 12 in the socket, and a lever 38 pivotally mounted in the plug body about a pivot 40 in its central region and, having a contact button 39 at one end. The free end of the spring contact 36 abuts one side of the lever 38 adjacent its pivot 40, normally biassing the lever 38 into the position shown in FIG. 4.

The rocker 32 has a nose 40 which abuts the side of the lever 38 remote from the spring contact 36. The rocker also comprises a stop 43, against which the lever 38 rests in the "switch off" position (FIG. 4).

The action of the switch 30 is as follows. A user presses the rocker 32 into the "switch on" (FIG. 3). In this position, the nose 42 of the rocker 32 abuts the lever 38 on that side of the lever pivot 40 adjacent the contact button 39, which is therefore urged by the nose into contact with a contact button 29 connected to the terminal 28. Electrical connection is thus made between the plug contact pin 22 and the positive terminal 28.

Figure 4:
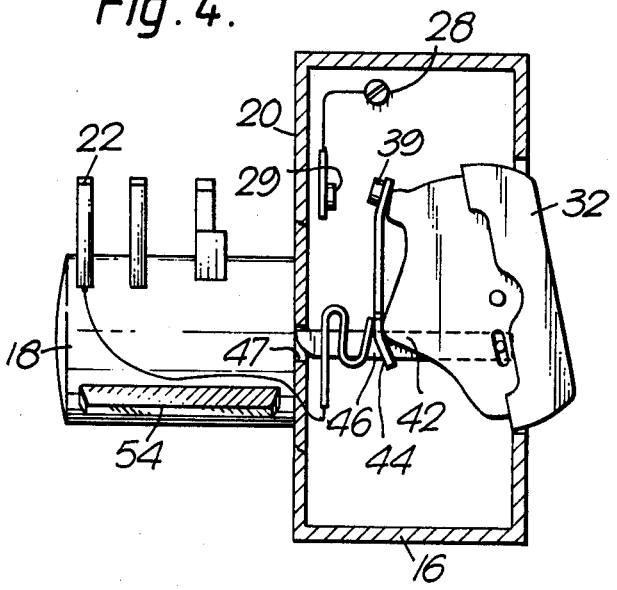
FIG. 4 is a view similar to that of FIG. 3, but with the switch in the off position.

To switch off, the user presses the rocker 32 into the position shown in FIG. 4, which causes the nose 42 of the rocker to sweep along the lever 38 past the over dead-centre position of the lever. The lever 38 then see-saws about its pivot 40 so as to separate the contact buttons 29 and 39. The off position of the rocker 32 is defined by its nose resting against a cranked end 44 of the lever 38, the other end of the lever resting against the stop 43 on the rocker. The spring contact 36 discourages the nose 42 from resting at the over dead-centre position of the lever 38, so that rapid and positive switching into both the on and off positions is achieved.

Switch control means, comprising a pin 46 slidably mounted in the plug body, is provided to move the switch 30 into the off position when the plug 10 is inserted and when it is removed from one of the sockets 11. The pin 46 is slidably mounted on guide surfaces on the plug body, these surfaces including an aperture 47 in the front face 20 of the plug body. The pin 46 has, at one of its ends, a peg 48 slidably received in a slot 50 in the rocker 32. The other, free end 52 of the pin 46 has a cam surface thereon.

Figure 2:
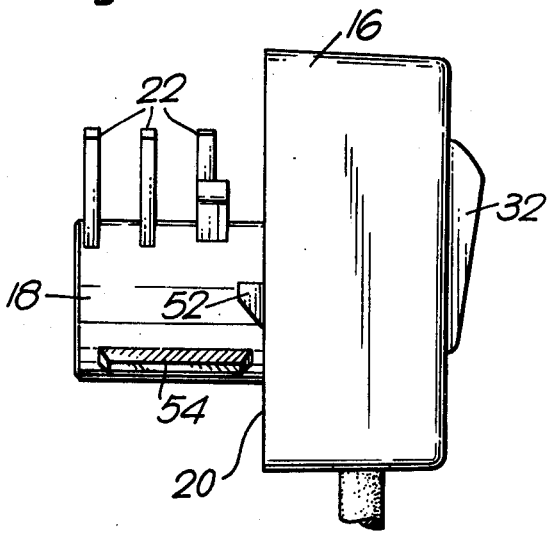
FIG. 2 shows a side view of the plug shown in FIG. 1.

To insert the plug 10 into the socket 11 as previously described, the projecting portion 18 of the plug is first inserted, in the direction of arrow A, into the aperture 24 of the socket 11. A rib 54 on the projecting portion 18 mates with a recess 56 in the front wall 26 of the conduit 14 to positively locate the projecting portion 18 with respect to the socket, both angularly and axially. If the switch 30 is in the on position, the free end 52 of the axially slidable pin 46 will project through the front wall 20 of the plug body (FIGS. 2 and 3). If the plug is inserted with the switch on, the exposed free end 52 of the pin 46 will engage the front wall 26 of the conduit towards the end of the travel of the plug in the direction of arrow A. The end 52 of the pin will engage a region 26' of the front wall 26 immediately adjacent the aperture 24 of the socket 11. On pushing the plug fully home in the direction of arrow A, the wall region 26' will force the pin 46 axially into the plug body 16, and the pin, by engagement of its peg 48 with the rocker 32, will urge the rocker 32 into the off position shown in FIG. 4. The plug can then be rotated in the direction of arrow B for the pins 22 to contact the conductors 12 without the possibility of arcing occurring between the plug pins and socket conductors.

Once the plug 10 has been rotated in the direction of arrow B, its pins 22 will project upwardly, in the illustrated embodiment, and the aperture 47 in the front face 20 of the plug body will be in a position adjacent region 24' of the aperture 24. In this position of the plug, the end 52 of the slidable pin 46 will be free to project through the aperture 47 into the socket aperture 24, so that the switch 30 can be switched on and off at will without interference by the switch control means.

When a user wishes to remove the plug 10 from the socket 11, the switch 30 may be in the on position, but the switch control means will ensure that it is moved to the off position before the plug is fully removed from the socket 11. Suppose the switch 30 is in the on position, and the free end 52 of the pin 46 will therefore be projecting out of the plug body 16 (FIG. 2). To remove the plug, a user first turns the plug in the direction opposite that of arrow B. After turning through a few degrees, the end 52 will abut region 26'' of the front wall 26 of the conduit 14 immediately adjacent the aperture 24 of the socket 11. The cam surface on end 52 co-operates with the region 26'' to urge the pin 46 back into the plug, thus moving the switch 30 into the off position. Rotation of the plug through 90° is then completed and the plug withdrawn by moving it in the direction opposite that of arrow A.

Figure 5:
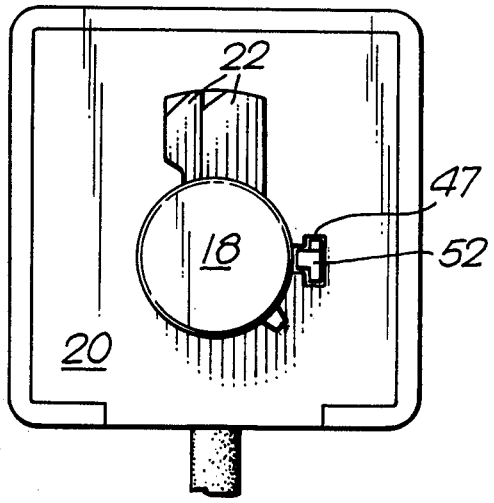
FIG. 5 is a view of the face of the plug.

It can be seen from FIG. 5 that the pin 46, at least in the region adjacent its free end 52, is of non-circular cross-section and in this embodiment is of T-section. The aperture 47 in the front face 20 of the plug body 16 is of complementary T-shape. If the free end 52 of the pin were of circular cross-section, rotation of the plug might cause the pin to rotate about its own axis, so that the cam surface would be incorrectly orientated with respect to the region 26'' of the socket surface, which would frustrate correct retraction of the pin 46.

It is desirable if the surface 26' and 26'' and the conductors 12 are disposed so that the switch is moved to the off position before contact between the pins 22 and conductors 12 is made, when inserting the plug, or broken, when removing the plug from the socket. In this way, arcing between the pins 22 and conductors 12 is avoided.

Although the invention has been illustrated by an embodiment in which the plug is rotationally engaged with the socket, it would be possible to apply the invention to conventional two- or three-pin plugs. In this case, the switch control means could comprise an operating element which is spring biassed to project from the front face of the plug and retracted by engagement of the front face of the plug with the socket on insertion of the plug, to turn the switch into the off position. Once the operating element, e.g. sliding pin, is in its retracted position, it would be adapted to be free of the switch, so that a user would be able to switch the plug on and off while the plug is in the socket. Advantageously, the switch control means would additionally include means for tripping the switch into the off position during the initial retraction movement of the plug from its socket.

We claim:

1. In an electrical plug of the type which is designed for insertion into a complementary socket, the plug comprising a plug body housing at least one terminal to which cable leads may be connected, and at least one corresponding contact pin projecting from the body, and a switch electrically connected between the terminal and the contact pin, the switch having first and second conductive elements and a non-conductive manual control element which is movable between an on position, in which the terminal and contact pin are conductively connected via the conductive elements, and an off position in which the terminal and contact pin are electrically isolated from one another, and switch control means adapted to be cooperable with a surface on said socket for automatically moving the control element into the off position when the plug is being inserted into a socket and when the plug is being removed from a socket.

2. An electrical plug as claimed in claim 1, wherein the switch control means comprises an element movably mounted on the plug body, one portion of the element being operatively connected to the switch, a further portion of the movable element projecting out of the plug body when the switch is in the on position, said further portion of the element being retractable into the plug body when it engages said surface on the socket, the element thereby urging the switch into the off position when the plug is inserted into and removed from the socket.

3. An electrical plug as claimed in claim 2, wherein the movable element comprises an axially slidable pin, one end of which is pivotally connected to the switch control element, the other, free end of the pin projecting out of the plug body when the switch is in the on position.

4. An electrical plug as claimed in claim 3, wherein the plug is of the kind adapted to be engaged with the socket by axially urging the plug into the socket followed by rotation of the plug through substantially 90°, the free end of the axially slidable pin being formed with a cam surface for engagement with said surface on the socket to cause retraction of the pin on removal of the plug from the socket.

5. An electrical plug as claimed in claim 4, wherein the axially slidable pin is mounted on a guide surface on the plug body, the axially slidable pin being of non-circular cross-section and the guiding surface for the pin being of complementary cross-section to that of the pin, whereby, as the plug is rotated to remove it from the socket, the pin is restrained from rotating about its longitudinal axis, so that cooperation between the cam surface on the free end of the pin and the surface of the socket causes the pin to move axially, substantially without rotation.

6. An electrical plug as claimed in claim 1, wherein the switch comprises an over-center snap switch.

7. An electrical plug as claimed in claim 1 in combination with a complementary socket which houses electrical conductors, wherein the switch control means is adapted to move the switch control element automatically into the off position before contact is made between the contact pins and the conductors on insertion of the plug into the socket and before contact is broken between the contact pins and conductors before the plug is removed from the socket.

* * * * *